United States Patent [19]

Köhler et al.

[11] Patent Number: 4,483,279

[45] Date of Patent: Nov. 20, 1984

[54] SINGLE-CYLINDER MOTOR

[75] Inventors: Gisbert Köhler, Fellbach; Michael Leuchte, Herrenberg, both of Fed. Rep. of Germany

[73] Assignee: Andreas Stihl, Waiblingen, Fed. Rep. of Germany

[21] Appl. No.: 437,314

[22] Filed: Oct. 28, 1982

[30] Foreign Application Priority Data

Oct. 31, 1981 [DE] Fed. Rep. of Germany ..... 3143246

[51] Int. Cl.[3] ..... F02P 1/02

[52] U.S. Cl. ..... 123/41.65; 123/195 R; 123/185 A; 123/179 SE; 123/149 D

[58] Field of Search ..... 123/195 R, DIG. 3, 41.65, 123/41.66, 149 R, 149 D, 179 SE, 185 A, 185 B

[56] References Cited

U.S. PATENT DOCUMENTS

| | | | |
|---|---|---|---|
| 1,447,371 | 3/1923 | Andrews et al. | 123/149 D |
| 1,474,467 | 11/1923 | Ferguson | 123/195 A |
| 2,157,666 | 5/1939 | Jacobi | 123/149 D |
| 2,177,199 | 10/1939 | Lansing | 123/185 A |
| 2,533,487 | 12/1950 | Maurer et al. | 123/41.65 |
| 3,601,226 | 8/1971 | Masaoka et al. | 123/179 SE |
| 3,747,649 | 7/1973 | Densow et al. | 123/179 SE |

*Primary Examiner*—Craig R. Feinberg

*Assistant Examiner*—David A. Okonsky

*Attorney, Agent, or Firm*—Walter Ottesen

[57] ABSTRACT

A single-cylinder motor having a crankshaft mounted or journalled in the crankcase by means of roller-bearing sets. A crank web or lobe with a crankshaft pin is arranged at one end of the crankshaft. The crankshaft pin is drivingly connected via a connecting rod with the piston of the piston-cylinder unit. The other end of the crankshaft, in the region of the end segment thereof, carries the rotor of a magneto ignition device, whereby an end journal of the crankshaft can be coupled with a power take-off or output member. To journal or mount the crankshaft, the roller-body sets are arranged axially nondetachable in a sleeve which coaxially surrounds the crankshaft, whereby the sleeve is pressed or forced into a recess of the crankcase. The sleeve, the roller body sets, and the crankshaft form a structural unit capable of being preassembled. As a result, it is possible to securely press into place both roller body sets, whereupon the thus preassembled structural unit is securely mounted in the recess of the crankcase by being pressed therein. The assembly into the crankcase is uncomplicated and saves time. The arrangement of the roller body sets according to the present invention additionally makes possible a shorter overall length of the single-cylinder motor.

8 Claims, 2 Drawing Figures

29
38
2
1
33
30
3
27
35
28
24
18
4
15
10
26
37
12
6
13
36
8
14
17
21
19
11
9
36
23
32
31
20
16
4
7
22
34
25

SINGLE-CYLINDER MOTORsu

FIELD OF THE INVENTION

The present invention relates to a single-cylinder motor having a crankshaft mounted or journalled in a crankcase by means of roller body units or sets; at one end of the crankshaft is arranged a crank web having a crankshaft pin which is drivingly connected via a connecting rod with a piston of a piston-cylinder unit; the other end of the crankshaft supports the rotor of a magneto ignition device, and can be coupled with an output or power take-off.

BACKGROUND OF THE INVENTION

With a known motor according to German Pat. No. 949,697, a roller or anti-friction bearing is provided at each of the two ends of the crankshaft. Only one of these anti-friction bearings can be fastened by means of a press fit or force fit because of technical difficulties; the other anti-friction bearing must be secured with other known means. The arrangement of the anti-friction bearings can only occur after installation of the crankshaft is complete, which makes the installation thereof more difficult and leads to a longer assembly time; for this reason, the assembly of the motor is very expensive. The known arrangement of the anti-friction bearings additionally requires a relatively long overall length, which is undesirable particularly with single-cylinder motors constructed as small or fractional horsepower motors.

SUMMARY OF THE INVENTION

It is an object of the present invention to provide a quick and simple-to-assemble bearing arrangement which makes possible a press fit securing of both of the anti-friction bearings while reducing the overall length.

The single-cylinder motor of the present invention is characterized primarily in that the roller body sets are arranged axially non-detachable in a sleeve which coaxially surrounds the crankshaft; the sleeve is pressed into a recess of the crankcase, whereby the sleeve, the roller body sets, and the crankshaft form a structural unit which can be preassembled.

The roller body sets for mounting or journalling the crankshaft can be mounted in the sleeve externally of the crankcase, whereby the sleeve, the roller body sets, and the crankshaft form a structural unit. A press fit securing of both roller bearing groups is possible in this structural unit which can be preassembled; additionally, a shorter overall length is obtained due to the arrangement of the roller body sets between the crankshaft and the sleeve. The preassembled structural unit is securely mounted in the crankcase by pressing the sleeve into a recess of the crankcase; this can be done quickly and easily.

According to one specific embodiment of the present invention, a part of the sleeve which projects from the recess and out of the crankcase may serve as a crankshaft pin or support for the rope drum of a pull-rope starting device. Such an arrangement makes possible a short overall length of a single-cylinder motor provided with the necessary starting and operating devices.

Pursuant to yet other features of the present invention, the inner raceway of at least one roller body set may be placed in the outer periphery of the crankshaft, and the associated outer raceway of the roller body set may be placed in the sleeve.

The ends of the sleeve may be sealed off with sealing rings relative to the crankshaft. The sleeve may be made in one piece.

The roller body sets are each respectively arranged adjacent to one end of the sleeve.

The rotor may be constructed as a fan wheel, the axially arranged fan blades of which preferably project axially beyond a clutch which is connected with the free end of the shaft. The rope drum, the fan wheel, and the clutch may be located closely adjacent to one another and may partially overlap one another.

The single-cylinder motor, with its auxiliary devices, such as the cable drum, the rotor, and the clutch, may be enclosed by a housing which engages tightly against the crankcase, yet is open rearwardly in the region of the cylinder on that side remote from the output, and has air supply slots located axially of the fan wheel. An exhaust and a carburetor may be arranged externally of the housing, one on each side of the cylinder, as seen in the axial direction of the crankshaft.

BRIEF DESCRIPTION OF THE DRAWING

The invention will now be described with reference to the drawing wherein.

DESCRIPTION OF THE PREFERRED EMBODIMENTS OF THE INVENTION

Figure 1:
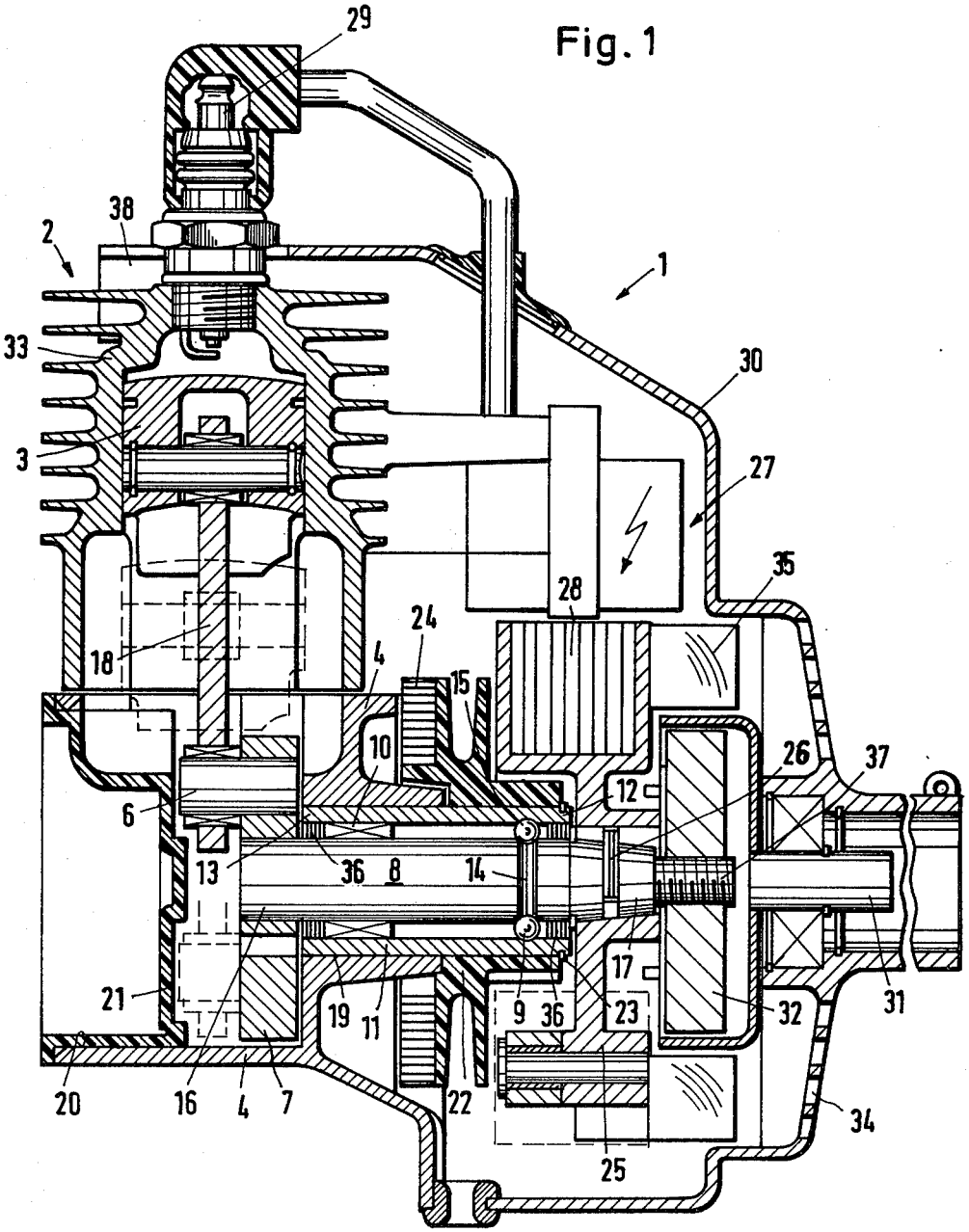
FIG. 1 is a section through one inventive embodiment of a single-cylinder motor taken longitudinally of the front crank thereof.

Referring now to the drawings in detail, the single-cylinder motor 1 essentially comprises a piston-cylinder unit 2 with a crankcase 4 which is attached in the direction of movement of the piston and is preferably made of die cast aluminum.

The crankshaft 8 of the single-cylinder motor 1 is mounted in a sleeve 11 by means of roller body sets or units 9,10; the sleeve 11 is tightly pressed into a receiving means or recess 19 of the crankcase 4. Each roller body set 9 and 10 is respectively arranged near one end 12, 13 of the sleeve 11. Sealing rings 36 are provided between the sleeve 11 and the crankshaft 8 at the ends 12, 13 of the sleeve 11; the sealing rings 36 seal off the inner space of the sleeve 11, thus protecting the roller body sets 9, 10 against penetration of dirt.

Advantageously, the inner raceway 14 of a roller body set 9 is formed in the outer periphery of the crankshaft 8, while the corresponding outer raceway 15 is provided in the sleeve 11, which is preferably made in one piece.

The crankshaft 8, along with the roller body sets 9,10, the sealing rings 36, and the sleeve 11, form a structural unit which can be preassembled. The sleeve 11, which serves as a bearing ring for the roller body sets 9, 10, is securely pressed into the recess 19 of the crankcase, which concludes the installation of the crankshaft 8. The end 13 of the sleeve 11 is advantageously flush with the inner wall of the crankcase 4.

Figure 2:
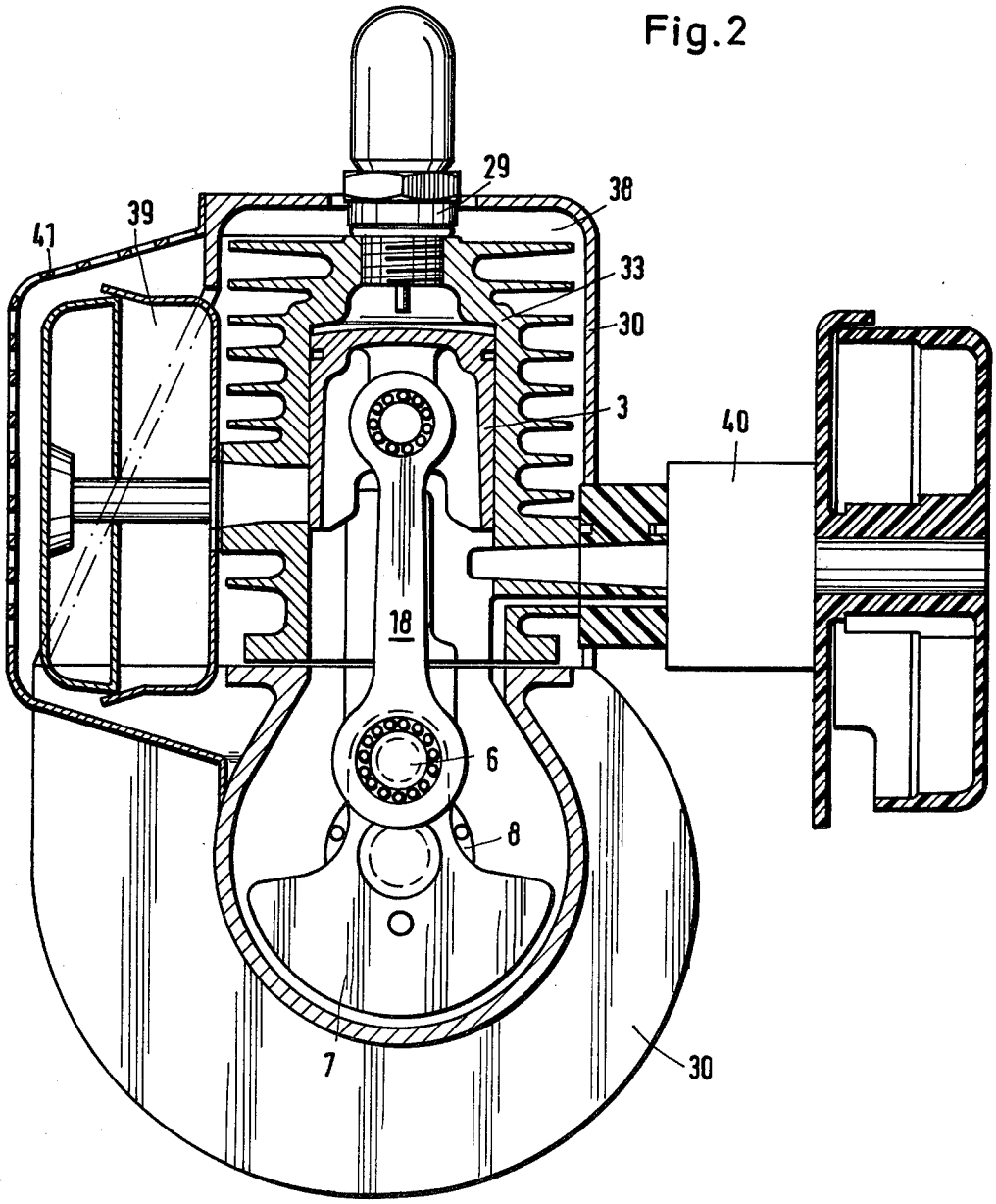
FIG. 2 is a partially sectioned view of the end face of the front crank with an opened crankcase.

The crankcase 4 is open on that side remote from the output or driving end of the shaft for easier installation or assembly, as apparent from FIG. 2. The opening 20 is closed with a closure 21 after installation or assembly is concluded; this closure 21 is advantageously made of a synthetic material.

It can be advantageous, especially for easier preassembly of the structural unit, to only provide the inner and outer raceway of one roller body set in the crankshaft 8 and the sleeve 11, and to arrange a roller body set 10 of different construction in the vicinity of the other end 13 of the sleeve 11, with such roller body set 10 being secured axially by means not illustrated in greater detail.

A crank web 7 is preferably shrunk fit upon that end 16 of the crankshaft 8 located in the crankcase 4; the crankshaft pin 6 is fastened in the crank web 7, for example by being pressed or forced into place. The piston 3 is drivingly connected via the connecting rod 18 with the crankshaft pin 6.

The recess 19 extends axially over approximately half of the sleeve 11, with that end of the latter which projects from the crankcase 4 serving as a support for the rope drum 22 of a cable- or rope-pull starting device. The rope drum 22 is axially fixed by a retaining ring 23 located in the sleeve 11. A helical or spiral spring 24 is inserted in a recess on that end face of the rope drum which faces the crankcase 4. One end of the spiral spring is rigidly connected with the rope drum 22 in a manner not illustrated in greater detail, and the other end is rigidly connected with a crankcase 4.

The rope drum 22 is arranged closely adjacent to the crankcase 4, whereby the rope drum 22 partially overlaps the recess 19.

A fan wheel or rotor 25 is placed on the preferably conical end segment 17 of the crankshaft 8, which end segment projects from the sleeve 11. This fan wheel 25 is nonrotatably connected with the crankshaft 8 by a slotted or splined pin 26. The fan wheel 25 is also provided as a rotor for the magneto ignition device 27, and supports the magnet 28 of the ignition device. The fan wheel 25 is arranged in such a way that it partially overlaps the hub of the rope drum 22. Pawls, detents or ratchets are provided on the fan wheel 25 in a known manner on that end face which faces the rope drum 22; these detents nonrotatably connect the rope drum 22 of the rope-pull starting device with the blades of the fan wheel 25 during start-up. The rope drum 22 rotatably takes along the fan wheel 25, and hence also rotatably takes along the front crank, which comprises the crankshaft 8, the crank web 7, and the crankshaft pin 6. The magnet 28 effects a voltage pulse in the magneto ignition device 27; this pulse is transmitted to the spark plug 29 to release an ignition spark at the electrodes thereof. After the single-cylinder motor has started, the faster rotating fan wheel 25 disengages from the rope drum, which is reset or returned to its rest position by the spiral spring 24, whereby the starting rope is rewound again.

The rotor blades 35 arranged axially on the fan wheel or rotor 25 overlap a centrifugal clutch 32, the drive part of which is connected with the end journal of the crankshaft 8, and the output part of which is connected with an output or power take-off pin or journal 31 which is journalled in a housing 30. Beyond a threshold speed, the centrifugal clutch 32 connects the crankshaft 8 with the output journal 31 for transmission of power.

The output journal 31 is mounted or journalled in a substantially closed, cup-shaped housing 30 into which the single-cylinder motor 1 is placed. The housing 30 is tightly connected with the crankcase 4, and is only open in the vicinity of the cylinder 33 on that side opposite to the output. The housing 30 is advantageously made of die cast magnesium. Air-supply slots 34 are provided in the housing axially of the fan wheel 25; the drawn-in air is blown out through an opening 38 in the rear wall of the housing 30. This has the advantage that besides a sufficient cooling of the piston-cylinder unit 2, also the centrifugal clutch 32 as well as the magneto ignition device 27 are cooled. Furthermore, all devices necessary for starting or operating the single-cylinder motor 1 are protected by the housing 30, so that damage to these devices can be extensively prevented.

As seen in FIG. 2, an exhaust 39 and a carburetor 40 are arranged externally of the housing 30 on both sides of the cylinder as viewed in the longitudinal direction of the crankshaft 8. The exhaust 39 and the carburetor 40 are flanged directly to the cylinder 33, with a screen 41 being disposed around the exhaust 39 as a protection against contact therewith. The screen 41 is fastened to the crankcase 4 as well as to the housing 30.

The single-cylinder motor according to the present invention has a very small overall length due to the advantageous arrangement of the devices necessary for operation. The number of individual parts is considerably reduced compared with previously known motors, so that the manufacturing costs are small. Furthermore, a simple preassembly is possible due to the inventive crankshaft mounting design, so that the assembly of the motor can occur quickly and simply.

The length of the sleeve 11 can be adapted to the respective recess 19 and to the length of the required support for the rope drum 22. The sleeve 11 basically is shorter than the crankshaft 8, so that necessary parts can be arranged on the crankshaft ends.

The present invention is, of course, in no way restricted to the specific disclosure of the specification and drawings, but also encompasses any modifications within the scope of the appended claims.

What we claim is:

1. A single-cylinder motor comprising:

a piston-cylinder unit including a cylinder and a piston slidably engaging said cylinder, and a connecting rod having an end pivotally connected to said piston;

a preassembled crankshaft unit including: a continuous single sleeve; a crankshaft arranged in said sleeve so as to project outwardly beyond the respective ends thereof; and, bearing means longitudinally spaced along said crankshaft and in contact with said crankshaft and said sleeve for rotatably mounting said crankshaft in a spaced relationship to and in said sleeve so as to secure said crankshaft against axial movement relative to said sleeve;

a crankcase defining an opening;

said sleeve being press-fit mounted in said opening whereby said preassembled crankshaft unit is securely held in said crankcase; and, a crank web mounted on one end of said crankshaft, said crank web having a crankshaft pin pivotally connected to an opposite end of said connecting rod.

2. The single-cylinder motor of claim 1, said bearing means including: a bearing having an inner race formed as a groove in said crankshaft; an outer race formed as a groove in the inner wall surface of said sleeve; and, roller means disposed between said races.

3. The single-cylinder motor of claim 2, said bearing being at one end of said sleeve and said bearing means including a second bearing at an opposite end of said sleeve.

4. The single-cylinder motor of claim 2, said preassembled crankshaft unit comprising: two seals provided at respective ends of said sleeve for tightly sealing against said crankshaft; and, said sleeve being a single solid piece devoid of openings in its surface.

5. A single-cylinder motor comprising:

a piston-cylinder unit including a cylinder and a piston slidably engaging said cylinder, and a connecting rod having an end pivotally connected to said piston;

a preassembled crankshaft unit including: a continuous single sleeve; a crankshaft arranged in said sleeve so as to project outwardly beyond the respective ends thereof; and, bearing means for rotatably mounting said crankshaft to and in said sleeve so as to secure said crankshaft against axial movement relative to said sleeve;

a crankcase defining an opening;

said sleeve being press-fit mounted in said opening whereby said preassembled crankshaft unit is securely held in said crankcase;

a crank web mounted on one end of said crankshaft, said crank web having a crankshaft pin connected to an opposite end of said connecting rod;

said sleeve having an end portion projecting from said crankcase in a direction away from said crank web so as to define a cylindrical bearing surface;

a pull rope starting device including a rope drum rotatably mounted on said cylindrical bearing surface; and, a magneto-ignition device including a rotor mounted on an opposite end of said crankshaft; said rotor being configured so as to cause a portion thereof to axially overlap said rope drum in telescopic fashion whereby an axially compact arrangement of said rotor and said rope drum are obtained.

6. The single-cylinder motor of claim 5 comprising: a coupling mounted on said opposite end of said crankshaft adjacent said rotor on a side thereof facing away from said sleeve; a further portion of said rotor being formed as a plurality of vanes to define a fan wheel, said vanes being disposed on said rotor so as to overlap said coupling.

7. The single-cylinder motor of claim 6 comprising: a housing abutting said crankcase and enclosing said piston-cylinder unit, said rope drum, said rotor, and said coupling; said housing defining an opening facing away from said coupling and having a plurality of air conducting slits formed therein axially of said fan wheel.

8. The single-cylinder motor of claim 7 wherein the longitudinal axis of said cylinder and the longitudinal axis of said crankshaft conjointly define a plane, the motor further comprising: a muffler arranged exterior of said housing to one side of said plane and a carburetor arranged exterior of said housing to another side of said plane.

* * * * *